United States Patent [19]

Hirose et al.

[11] 3,964,905

[45] June 22, 1976

[54] COLOR PHOTOGRAHIC MATERIAL HAVING A BLEACH INHIBITOR THEREIN DEFINING A SOUND TRACK

[75] Inventors: Takeshi Hirose; Yasushi Oishi; Tadao Sakai, all of Minami-ashigara, Japan

[73] Assignee: Fuji Photo Film Co., Ltd., Minami-ashigara, Japan

[22] Filed: Mar. 13, 1974

[21] Appl. No.: 450,938

[30] Foreign Application Priority Data

Mar. 13, 1973 Japan ..... 48-29252

[52] U.S. Cl. ..... 96/4; 96/22; 96/39; 96/60 R

[51] Int. Cl.[2] ..... G03C 7/24

[58] Field of Search ..... 96/4, 22, 111, 39, 60 R

[56] References Cited

UNITED STATES PATENTS

| | | | |
|---|---|---|---|
| 2,258,976 | 10/1941 | Dearing | 96/4 |
| 2,763,550 | 9/1956 | Lovick | 96/60 R |
| 3,243,295 | 3/1966 | Vogt | 96/4 |
| 3,705,800 | 12/1972 | Lane | 96/4 |
| 3,705,802 | 12/1972 | Baptista | 96/60 R |
| 3,705,803 | 12/1972 | Bevis et al. | 96/4 |
| 3,737,312 | 6/1973 | Baptista et al. | 96/4 |
| 3,813,244 | 5/1974 | Villard | 96/22 |

*Primary Examiner*—David Klein
*Assistant Examiner*—Judson R. Hightower
*Attorney, Agent, or Firm*—Sughrue, Rothwell, Mion, Zinn & Macpeak

[57] ABSTRACT

A color photographic cine or TV film on which a sound recording band or track can be formed without the necessity for a specific additional treatment comprising a film base having thereon at least a silver halide emulsion layer containing a coupler capable of forming a dye by the coupling reaction with the oxidation product of an aromatic primary amino developing agent, and at least one of the emulsion layers of the color photographic material containing a bleach inhibitor in only the portion defined as the sound recording track.

23 Claims, No Drawings

COLOR PHOTOGRAHIC MATERIAL HAVING A BLEACH INHIBITOR THEREIN DEFINING A SOUND TRACK

BACKGROUND OF THE INVENTION

1. Field of the Invention

The present invention relates generally to a color photographic material and, more particularly, it relates to a color photographic film capable of recording sound.

In general, as systems of recording sound images on color photographic films used in movies or television, there are an optical recording system and a magnetic recording system and the present invention relates to a color photographic film suitable for the optical recording system.

2. Description of the Prior Art

Sounds recorded in color print films, color reversal films, color reversal print films, etc., used in the fields of movies or television are reproduced by converting the sound signals recorded in the film as changes in density or area into light signals, converting the light signals into electric signals by means of a photoacceptor, and further converting the electric signals into sound signals again. As the photoacceptor used in the sound reproduction steps, photoelectric tubes having various spectral characteristics are used. Among them, a so-called S-1 type photoelectric tube is most frequently used and this photoelectric tube has a spectral sensitivity maximum at about 800 m$\mu$ in the infrared region (see, e.g., Adrin Cornwell Clyne, *Color Cinematography*, page 593 (1951)).

On the other hand, the main absorptions of the dyes formed by the coupling of color couplers and the oxidation product of a developing agent such as a paraphenylenediamine in color photographic materials for substractive color processes are all in the visible spectral region and those absorption spectral regions do not coincide with the spectral characteristics of the above-described photoelectric tube. Accordingly, if such dye images only formed by coupling are utilized for sound recording or reproduction, the sound output is too weak for practical use. Therefore, in order to conduct sound reproduction in color photographic materials, silver images or silver sulfide images are formed on recording tracks of the color photographic materials in the processing steps of the materials and the changes in density of the silver images or silver sulfide images in the infrared regions are utilized for the reproduction of sound. The infrared density (transmission density) in this case is usually about 1.0 or 1.6.

The formation of recording tracks in color print films are ordinarily conducted using the treatment as shown in, for instance, *Journal of the Society of Motion Picture and Television Engineers*, Vol. 77, 1054 (1968).

According to the process referenced above, the dye images in the image portions and the sound images in the sound recording portions are formed simultaneously by color development. That is to say, the unexposed silver halide in the color photographic films is removed in a first fixing bath and the developed silver formed in the development step is rehalogenated in a bleach bath. In the sound development step, a viscous sound developer is selectively coated on the sound recording portion of the color photographic film, whereby the silver halide at the sound recording portions only is converted into silver images. The silver halide at the image portions is removed in a second fixing bath and the dye images are stabilized in a stabilization bath. The density of the thus formed silver images in the sound recording track in the infrared region is utilized for the reproduction of sound.

Such a conventional system of producing sound recording tracks for color photographic films requires the step of forming silver images or silver sulfide images. Such a treatment of forming sound tracks is a step additionally required in addition to the steps of forming dye images in the image-forming portions. Such a sound recording track comprising silver or silver sulfide is formed since, as indicated above, the spectral sensitivity characteristics of the photoelectric tube used for the reproduction of sound has a sensitivity maximum in the infrared region, while the coupled dyes formed by the color development process do not have sufficient densities in this wave length region. The step of forming silver images or silver sulfide images in the sound recording tracks is additionally required besides the steps of forming dye images at the image portions as described above also and thus a method of forming sound images without the necessary for such a specific treatment step has been demanded.

As a means for resolving this problem, a color photographic material has been proposed which has a subsidiary silver halide emulsion layer containing a compound having the property of greatly reducing the bleaching speed in the bleaching step for the color photographic material or substantially destroying the bleaching action or containing a compound having the property of causing a bleaching action in only the initial period of the bleaching step to a definite bleaching extent and causing no further bleaching. Such a compound which suppresses or interrupts the bleaching action is hereinafter called a "bleach inhibitor".

However, such a color photographic material as proposed above requires a layer for the sound recording track in addition to the ordinary layers for providing dye images, which results in an increase in cost for the materials as well as for production. Also, the provision of sensitivity to such a layer for sound recording is accompanied by difficulties in that the sensitivity of the layer is reduced to less than those of the layers for the color images so that other images than sound images are not formed in the layer for sound recording and that the sensitivity of the layer is in different a wave length region than those of the layers for color images. Furthermore, by forming such a layer for sound recording, the thickness of the entire color photographic material increases and the sharpness of the color images formed in the color photographic material having such a sound recording layer tends to be reduced due to light scattering.

SUMMARY OF THIS INVENTION

An object of this invention is to provide a color photographic material in which a sound recording track or band can be formed without the necessity of forming a subsidiary silver halide emulsion layer for the sound recording track.

Another object of this invention is to provide a color photographic material which does not require a specific additional treatment as in conventional materials for forming sound recording tracks.

A further object of this invention is to provide a method of forming sound images in a color photographic film without the necessity for employing a specific treatment as in the conventional case.

These and other objects of this invention can be attained by incorporating a bleach inhibitor in the color photographic material at the portion only corresponding to the sound recording track.

Namely, the present invention, provides a color photographic material comprising a support having thereon at least one silver halide emulsion layer containing a coupler capable of forming a dye by the reaction with the oxidation product of an aromatic primary amino developing agent, and at least one of the emulsion layers of the color photographic material containing a bleach inhibitor at the portion only corresponding to a sound recording track.

DETAILED DESCRIPTION OF THE INVENTION

A conventional multilayer color photographic material usually comprises a support upon which are superimposed differently sensitized silver halide emulsion layers. When such a color photographic material is imagewise exposed and subjected to color development, dye images and silver images are formed. Then, the silver images are oxidized using a bleaching treatment and then removed from the photographic material through a fixing treatment. Thus, a color photograph composed of dye images is obtained.

In the color photographic material of this invention, on the other hand, the silver images in the portions corresponding to the dye image portions (hereinafter designated "dye image portions" or "color image portions") in the bleach step after color development while the silver images in the portions corresponding to sound recording track portions (hereinafter designated "sound recording track portions") remain unbleached and after finishing all of the processings, the dye image portions give clear dye images and the sound recording track portions give images composed of the silver images and dye images. That is to say, by employing the color photographic material of this invention, a color photograph having dye image portions composed of sharp dye images and sound recording track portions composed of silver images and dye images can be obtained by conducting ordinary color processings without the necessity of a specific treatment for forming sound recording tracks as employed in the conventional system.

According to one of the effective means for producing such a color photographic material of this invention, a coating composition containing a bleach inhibitor is coated on a sound recording track portion of the color photographic material after forming the dye image-forming emulsion layers on a support during the production of the color photographic material.

The step of coating the coating composition containing a bleach inhibitor can be conducted at any stage after coating the dye image-forming layers and before image-exposure of the color photographic material. That is to say, the coating composition can be coated before or after slitting the color photographic material having the dye image-forming emulsion layers to the appropriate size or further the composition may be coated simultaneously with the slitting.

According to one embodiment of this invention, the color photographic material has on a support a first silver halide emulsion layer containing a coupler capable of forming a yellow dye by reaction with the oxidation product of a color developing agent and having a sensitivity in a first visible region, a second silver halide emulsion containing a coupler capable of forming a magenta dye by reaction with the oxidation product of a color developing agent and having a sensitivity in a second visible region, and a third silver halide emulsion layer containing a coupler capable of forming a cyan dye by reaction with the oxidation product of a color developing agent and having sensitivity in a third visible region, the color photographic material having further a confined layer of a coating composition containing a bleach inhibitor in only the sound recording track portion which is formed by applying the coating composition after coating and drying the above-described silver halide emulsion layers.

When such a color photographic material is exposed to an appropriate orginal image and color developed, yellow dye images and silver images are formed in the first silver halide emulsion layer, magenta dye images and silver images in the second silver halide emulsion layer, and cyan dye images and silver images in the third silver halide emulsion layer. Then, when the photographic material thus developed is subjected to a bleaching treatment, the silver images formed in the dye image-forming portions are bleached in each silver halide emulsion layer. On the other hand, since the coating composition containing the bleach inhibitor has been coated on the sound recording track portion, the bleach inhibitor has permeated into the silver halide emulsion layers at the portion and thus the silver images at the sound track portion remain unbleached due to the action of the bleach inhibitor. Thus, a color photograph having dye images and sound recording images is obtained.

In the color photographic material according to this invention, a plurality of superposed, differently sensitized silver halide emulsion layers can be present. For example, on a support, a blue-sensitive emulsion layer containg a yellow dye-forming coupler, a red-sensitive emulsion layer containing a cyan dye-forming coupler and a green-sensitive emulsion layer containing a magenta dye-forming coupler can preferably be applied in order, or a red-sensitive emulsion layer containing a cyan coupler, a green-sensitive emulsion layer containing a magenta coupler and a blue-sensitive emulsion layer containing a yellow coupler, in order is also preferred.

In another preferred embodiment of the color photographic material of this invention, the bleach inhibitor is included in one or two silver halide emulsion layers only these silver halide emulsion layers being disposed farther from the support than the other silver halide emulsion layers. In such a kind of color photographic material, the silver images in the entire silver halide emulsion layer adjacent the support are bleached and only the silver images in the sound recording track portions of the upper one or two silver halide emulsion layers containing the bleach inhibitor remain unbleached. When such a color photographic material is used, sound recording having good sound quality or tone can be obtained since the silver images in the silver halide emulsion layer adjacent the support, these silver images having reduced sharpness due to the influence of light scattering on exposure are bleached, while the silver images in the upper silver halide emulsion layer or layers in the sound track portion having high sharpness remain.

In still another preferred embodiment of the color photographic material of this invention, the opposite or back surface of the support of the color photographic material carrying the photographic emulsion layers is marked with an appropriate dye or pigment, with a white pigment such as titanium oxide, zinc oxide, lead carbonate, etc. being particularly preferred, at the portion corresponding to the sound track portion. When such a color photographic material is used, the position of the sound recording track thereof can be readily be recognized by the marking at the back surface of the support at exposure.

Also, in a further embodiment of this invention, in the production of the color photographic material by applying to the sound track portion thereof the coating composition containing the bleach inhibitor after silver halide photographic emulsion layers are formed, an appropriate dye or dyes can be incorporated in the coating composition in addition to the bleach inhibitor. In such a color photographic material, the sound recording track portion is colored and hence the color dye-forming portions and the sound recording portions can be readily distinguished at exposure. It is preferred that the dye used for the purpose be of a color tone or concentration which does not excessively reduce the color sensitivities of the silver halide emulsion layers in the sound track portion.

The bleach inhibitors used in this invention can be those having the above-described properties and specific examples of them are those compounds having at least two oxyalkylene groups in the molecule as described in the specification of U.S. Pat. application Ser. No. 360,507, filed May 15, 1973. Other examples of bleach inhibitors are compounds having a mercapto group or a selenazole group as described in the specifications of Japanese Pat. application No. 64826/1972 and U.S. Pat. Nos. 3,705,800 and 3,705,803. Also, the compounds capable of forming the above-described compounds having a mercapto group or a selenazole group by hydrolysis as disclosed in U.S. Pat. Nos. 3,705,800 and 3,705,803 or reaction with the oxidized color developing agent as disclosed in U.S. Pat. No. 3,705,801 can be also used as the bleach inhibitor in this invention.

Furthermore, compounds having a thioether bond directly at the nitrogen-containing heterocyclic ring and compounds with a nitrogen-containing heterocyclic ring in which at least one nitrogen atom of the ring is connected to a group having more than 11 carbon atoms to form a quaternary salt can be used as the bleach inhibitor.

Specific examples of those bleach inhibitors used in this invention are illustrated below although the bleach inhibitors for use in this invention are not limited to these compounds only;

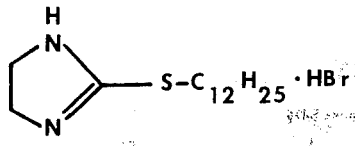

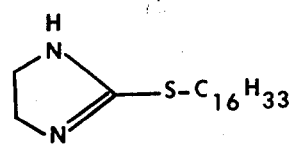

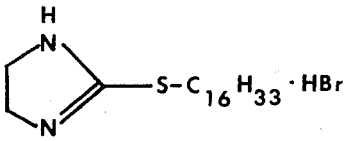

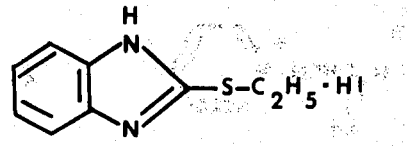

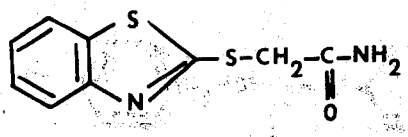

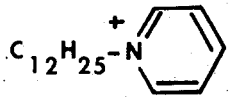

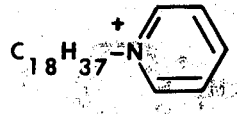

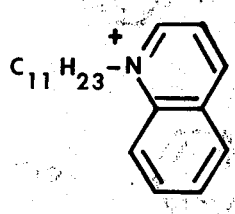

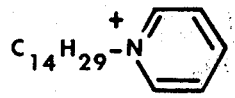

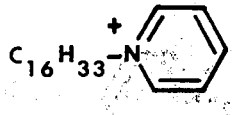

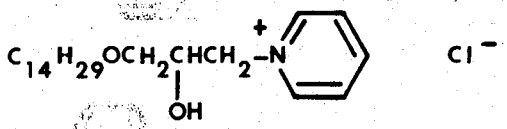

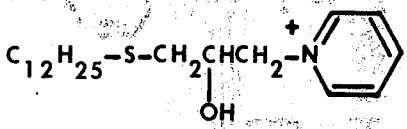

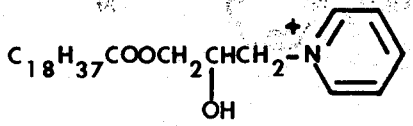

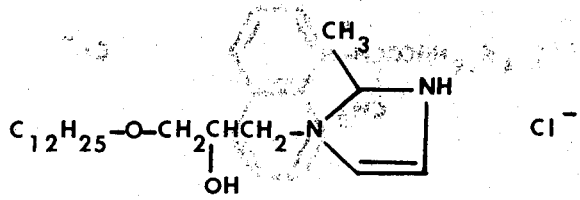

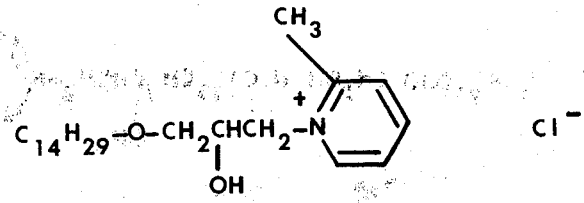

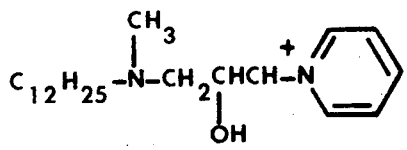
$Cl^-$
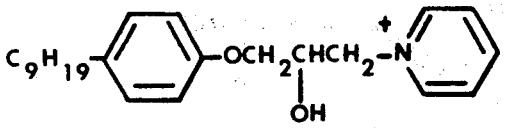
$Br^-$
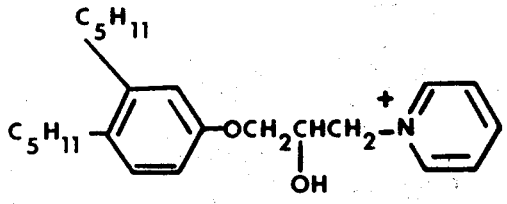
$Cl^-$
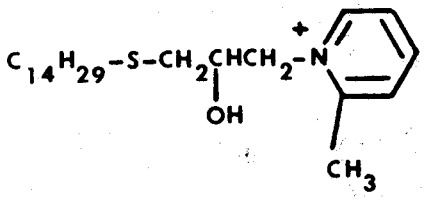
$Cl^-$
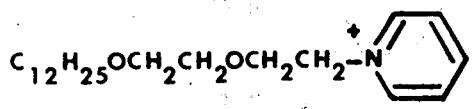
$Cl^-$
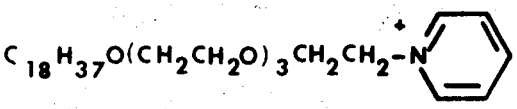
$Cl^-$
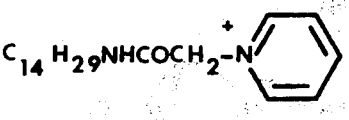
$Br^-$
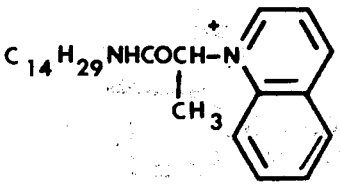
$Cl^-$
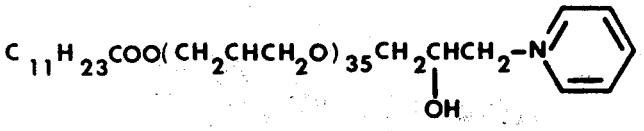
$Cl^-$
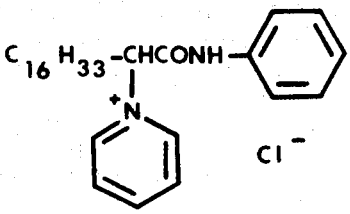
$Cl^-$
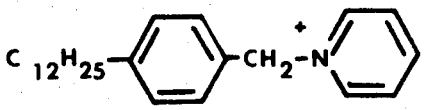
$Cl^-$
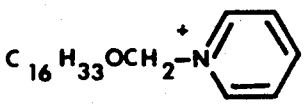
$Cl^-$
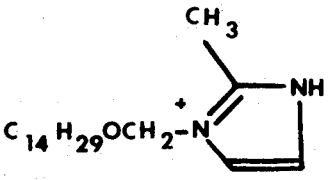
$Cl^-$
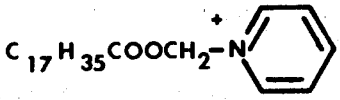
$Cl^-$
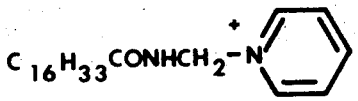
$Cl^-$
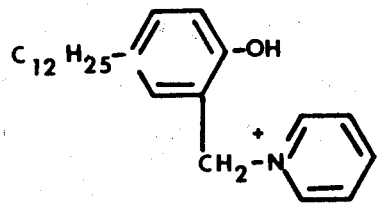
$Cl^-$
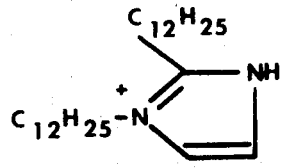
$Cl^-$

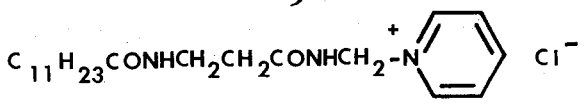

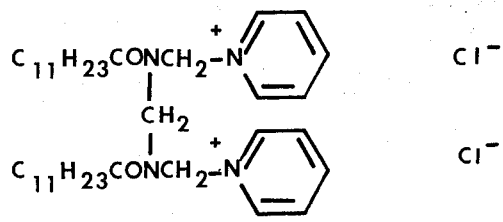

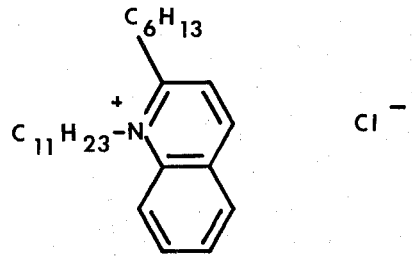

The above-illustrated compounds can be prepared using known methods and some of them are commercially available. For example, the pyridinium compounds can be prepared according to the method described in *Kogyo Kagaku Zasshi*, Vol. 63, pages 595–600 (1960) and Japanese Pat. Publication No. 21,983/71. The thioethers can be prepared according to the method described in *Analytical Chemistry*, Vol. 32, page 55 (1960).

Other examples of bleach inhibitors are compounds which react with gelatin in the silver halide emulsion layer or layers to harden the emulsion layer, whereby the bleaching action is suppressed, for example, as disclosed in U.S. Pat. Nos. 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 2,091,537; and 3,321,313. These compounds are conventionally used as hardening agents in photographic materials and specific examples of them are aldehyde-type compounds, methylol-type compounds, 1,4-dioxane-type compounds, aziridine-type compounds, isoxazole-type compounds, carbodiimide-type compounds, active halogen compounds, and active vinyl-type compounds. If these compounds are used in an amount less than a definite value, they act only as hardening agents and they do not exhibit any bleach inhibition action but when they are used in a large amount, they exhibit bleach inhibition action. This amount, of course, will vary over a wide range depending on the specific hardening agent. For example, when 2-oxy-4,6-dichloro-s-triazine sodium salt is used in a range of 4 – 40 wt% of the gelatin the bleach inhibiting effect can be observed.

According to this invention, the bleach inhibitor can be coated at any stage between the step of coating the silver halide emulsion layers and the step of exposure. The above described compounds can be used alone or as a mixture thereof.

The amount of the bleach inhibitor used in the color photographic materials of this invention depends greatly upon the properties of the bleach inhibitor itself and the properties of the silver halide emulsion employed but, in general, the amount is about $1 \times 10^{-9}$ g to $1 \times 10^{2}$ g, preferably about $1 \times 10^{-7}$ g to about 10 g, per square meter of the sound recording area.

Preferred examples of supports on which the photosensitive silver halide emulsions are applied for producing the color photographic materials of this invention are cellulose ester films such as cellulose nitrate films, cellulose acetate films, etc.; polyester films such as polyethylene terephthalate films; polyvinyl chloride films, polystyrene films, polycarbonate films; and the like.

Various hydrophilic colloids can be used as the binding agents for the silver halide emulsion layers in this invention. Preferred examples of such hydrophilic colloids are gelatin, albumin, gum arabic, agar agar, cellulose derivatives (such as an alkyl ester of carboxycellulose, hydroxyethyl cellulose, carboxymethyl hydroxyethyl cellulose, etc.,), synthetic resins (such as polyvinyl alcohol, polyvinyl pyrrolidone, etc.,), and the like. These hydrophilic colloids are also preferably used as the binding agents for other layers for the color photographic materials than the silver halide emulsion layers, such as, for instance, a protective layer, a filter layer, an intermediate layer, an antihalation layer, a subbing layer, a backing layer, etc.

The hydrophilic colloids used for the various layers of the color photographic materials of this invention are preferably hardened with a hardening agent such as an aldehyde-type hardening agent, a methylol-type hardening agent, a 1,4-dioxane-type hardening agent, an aziridine-type hardening agent, an isoxazole-type hardening agent, a carbodiimide-type hardening agent, an active halogen type hardening agent, and an active vinyl-type hardeing agent, for example, as disclosed in U.S. Pat. Nos. 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 2,091,537; and 3,321,313.

In the present invention, any silver halide emulsions conventionally used in the field of photography, such as a silver bromide emulsion, a silver iodobromide emulsion, a silver chloroiodobromide emulsion, a silver chlorobromide emulsion, a silver chloride emulsion, etc., can be used. Also, the so-called conversion halide-type silver halide grains as described in the specification of U.S. Pat. Nos. 2,592,250 and 3,622,318 and British Pat. No. 635,841 can also be used in this invention.

The photographic emulsion can be chemically sensitized by an active gelatin or a sulfur compound according to the process described in U.S. Pat. Nos. 1,574,944; 1,623,499; and 2,410,689. They can also be sensitized by a noble metal salt such as a palladium or a gold salt as described in U.S. Pat. Nos. 2,448,060; 2,399,083; and 2,642,361. Furthermore, they can be sensitized by a reducing agent such as a stannous salt as described in U.S. Pat. No. 2,487,850 or sensitized by a polyalkylene derivative. They can also be spectrally sensitized by a cyanine or merocyanine dye such as described in U.S. Pat. Nos. 2,519,001; 2,666,761; 2,734,900; 2,739,964; and 3,481,742.

The silver halide emulsion can contain a stabilizer such as a mercury compound or an azaindene described in U.S. Pat. Nos. 2,886,437 and 2,444,605 or a mercapto compound such as described in U.S. Pat. Nos. 2,403,927; 3,266,897 and 3,397,987, a plasticizer such as glycerol as described in Mees and James, *The Theory of Photographic Process*, page 53 – 54, The Macmillan Co., New York (1966) and in U.S. Pat. Nos. 2,904,434; 2,940,854, etc. and a coating aid such as saponin or polyethylene glycol monoaurylether as described in U.S. Pat. Nos. 3,415,649; 3,441,413; 3,502,473; 3,514,293; 3,506,449; 3,539,352; 3,545,974; 3,507,660; 3,442,654; 3,475,174; 3,462,520; 3,493,379; 3,516,833; 3,516,835; 3,589,906; 3,617,292; 3,619,199; and 3,663,229. Further, the emulsion can contain an antistatic agent such as described in U.S. Pat. Nos. 2,739,888; 3,428,456; 3,437,484; 3,457,076; 3,549,375; 3,549,369; 3,551,152; 3,552,972; 3,547,643; 3,564,043; 3,615,531; 3,625,695; 3,655,387; 3,653,906; 3,655,386; 3,686,368; 3,756,828; and 3,754,924, an ultraviolet absorber as described in U.S. Pat. Nos. 2,415,624; 3,052,636; 3,074,971; 3,085,097; 3,067,456; 3,215,536; 2,719,086; 2,537,877; 2,784,087; 2,882,150; 2,875,053; 2,739,971; 3,097,100; 3,060,029; 2,632,701; 2,888,346; and 2,748,021, and an optical brightening agent as described in U.S. Pat. Nos. 3,630,738; 3,615,544; 3,586,673; and 3,434,837 and British Pat. Nos. 1,332,475; 1,319,763; and 1,333,586.

In the present invention, all open-chained ketomethylenic yellow dye-forming couplers can be advantageously used. Typical examples of such yellow dye-forming couplers are benzoylacetanilide couplers, pivalylacetanilide couplers, etc.

Also, all magenta dye-forming couplers such as, for instance, pyrazolone couplers, indazolone couplers can be advantageously used in this invention. Furthermore, all cyan dye-forming couplers such as, for instance, phenol couplers, naphthol couplers, etc., can be used in this invention.

These couplers may have a group which can be released by coupling at the active carbon atom of the coupling position. It is preferred that the color coupler be of a non-diffusible type having a balast group in the molecular structure of the coupler.

The terms "a releasable group by coupling", "a ballast group", and "non-diffusible property" are those conventionally used in regard to color couplers and the meanings thereof will be easily understood by one skilled in the art.

In order to render the coupler non-diffusible, at least one hydrophobic group having not less than about 8 carbon atoms, such as an alkyl group or an alkylaryl group, is introduced into the molecule of the coupler in a conventional manner. Many examples of such hydrophobic groups are known in the art and can be used in the invention. The ballast group may be bonded to the coupler moiety, either directly or via an amino bond, an ether bond, a thioether bond, a carbonamide bond, a sulfonamide bond, urea bond, an ester bond, an imide bond, a carbonyl bond or a sulfonyl bond.

Examples of such ballast groups are illustrated in the following.

i. Alkyl and alkenyl groups:
For example, $$-CH_2CH\begin{matrix}C_2H_5\\C_2H_5\end{matrix}, -C_{12}H_{25}, -C_{18}H_{33}, \text{ or } -C_{17}H_{33}$$

ii. Alkoxyalkyl groups:
For example, $$-(CH_2)_3O(CH_2)_7CH_3 \text{ or } -(CH_2)_3OCH_2-\underset{\underset{C_2H_5}{|}}{CH}-(CH_2)_8CH_3$$

as described in Japanese Patent Publication 27563/'64 iii. Alkylaryl groups:
For example,

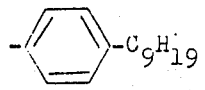

or

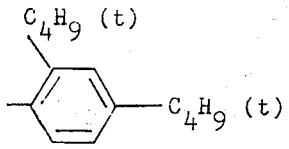

iv. Alkylaryloxyalkyl groups:
For example,

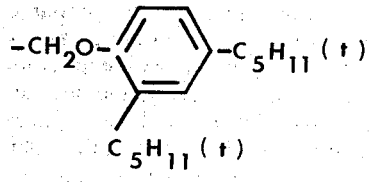

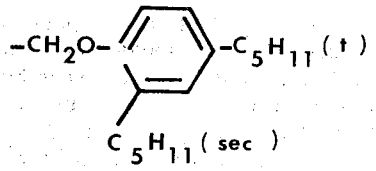

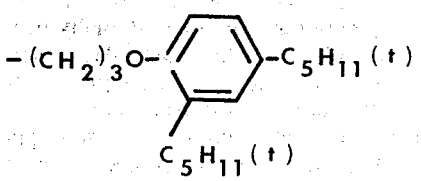

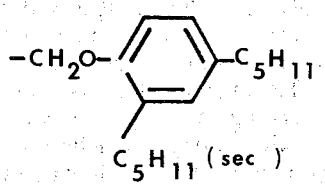

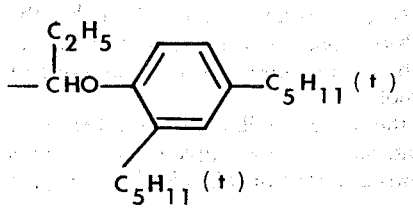

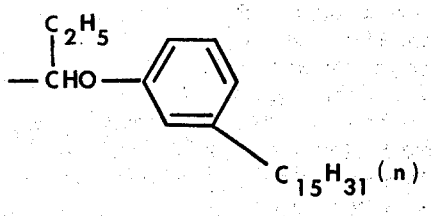

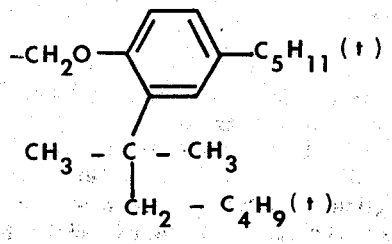

or

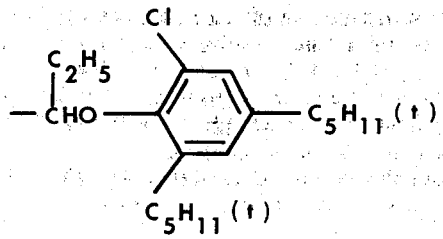

v. Acylamidoalkyl groups:
For example,

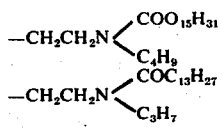

or

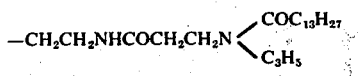

as described in U.S. Pat. Nos. 3,337,344 and 3,418,129.

vi. Alkoxyaryl and aryloxyaryl groups:

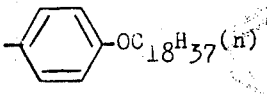

or

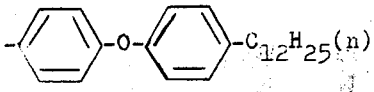

vii. Residual groups containing a long chain aliphatic group, such as an alkyl and/or an alkenyl group, together with a carboxyl or a sulfo group:
For example,

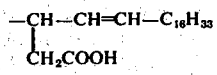

or

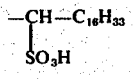

viii. Alkyl groups substituted with an ester group:
For example,

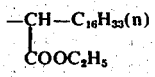

or ix. Alkyl groups substituted with an aryl group or a heterocyclic group:
For example,

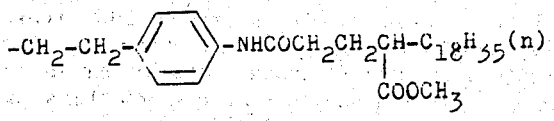

or

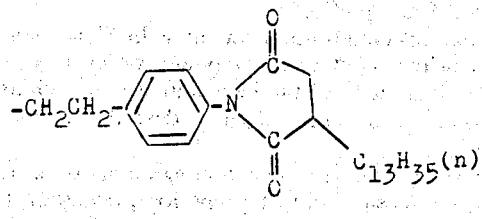

x. Aryl groups substituted with an aryloxyalkoxycarbonyl group:
For example,

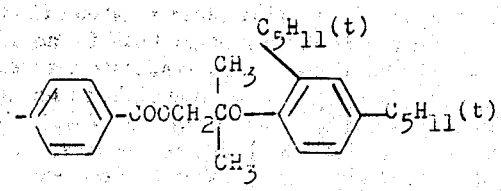

Examples of non-diffusible couplers which can be incorporated into the photographic silver halide emulsion layers of the photographic material are those described in U.S. Pat. Nos. 1,108,028; 2,186,849; 2,206,142; 2,343,702; 2,367,531; 2,369,489; 2,423,730; 2,436,130; 2,474,293; 2,600,788; 2,689,793; 2,728,658; 2,742,832; 2,808,329; 2,998,314; 3,046,129; 3,062,653; 3,265,606; 3,311,476; 3,408,194; 3,419,390; 3,419,391; 3,458,315; 3,476,563; 3,516,831; and 3,617,291 and British Pat. No. 1,183,515.

Various kinds of such color couplers are known and the particularly desirable color couplers used in this invention are selected from those color couplers which form yellow dyes having an absorption maximum in the wave length region of 420–460 mμ by reaction with the oxidation product of a color developing agent, those color couplers which form magenta dyes having an absorption maximum in the wave length region of 520–570 mμ by reaction with the oxidation product of a color developing agent, and those color couplers which form cyan dyes having an absorption maximum in the wave length region of 630–710 mμ by reaction with the reaction product of a color developing agent.

These color couplers are introduced in hydrophilic colloids using known techniques in the art. For instance, the color coupler can be dissolved in a high boiling organic solvent, e.g., a boiling point above 150°C such as dibutyl phthalate and tricresyl phosphate together with, if desired, a low boiling organic solvent such as ethyl acetate and tetrahydrofuran and then the solution is dispersed in a hydrophilic colloid. Also, when the color coupler has an acid group such as a carboxylic acid group or a sulfonic acid group, the color coupler can be added to a hydrophilic colloid as an alkaline aqueous solution thereof.

The coating composition containing the bleach inhibitor coated on the sound recording track portions of the color photographic materials of this invention contains, in addition to the bleach inhibitor, at least a solvent such as water and an organic solvent such as methanol, ethanol, propanol, acetone, methyl ethyl ketone, diacetonealcohol, methylacetate, ethylacetate, etc., which can be used, for example, at a concentration of about 0.1 to 10 g/liter, and it is desirable that such a solvent be easily evaporated off from the photographic materials in the drying step for them. From a practical standpoint, solvents having a boiling point lower than about 200°C are preferable.

The coating composition containing the bleach inhibitor can further contain a compound which can promote the dissolution of the bleach inhibitor, such as a appropriate surface active agent as described above as a coating agent.

Furthermore, the aforesaid coating composition can contain a viscosity control agent for preventing the coating composition from flowing over the color image portions of the color photographic film. As such a viscosity control agent, various compounds such as tragacanth gum, xanthane gum, and a copolymer of methyl vinyl ether and maleic anhydride (for instance Gantrez-AN, Registered Trademark of the GAF Corporation) can be advantageously used. In some instances precipitates are formed by the co-reaction of the bleach inhibitor and the viscosity control agent, and if such occurs it is only necessary to change the viscosity control agent to one in which precipitation does not occur. The viscosity control agent can be varied and generally is present in an amount of about 0.5 to 20 g/liter.

When the color photographic material of this invention is used as a positive color film for movies, perforations for advancing the film are formed at one or both edge portions of the film along the longitudinal direction.

When the color photographic film has perforations in only one edge portion, the sound recording track is generally formed along the opposite edge portion thereof and thus in this case it is preferable to coat the coating composition containing the bleach inhibitor on the edge portion of the film having no perforation. However, when the color photographic film has perforations in both edge portions, the sound recording track is formed along one edge portion having such perforations. Thus, in such a case it is convenient to put a mark to indicate the position of the coating of the bleach inhibitor in an appropriate manner. According to one of the marking methods, an appropriate mark can be provided on a predetermined edge portion of the back surface of the support of the color photographic film. For instance, a frame mark is put on the aforesaid portion of a positive color film for movies for indicating the position of the bleach inhibitor layer or band at printing from a negative color film. In such a case, the frame mark can be formed on the back surface of the film support at the side of the wedge portion corresponding to the side carrying the bleach inhibitor band or at the opposite side.

Also, according to another embodiment the sound recording track portion formed by coating the bleach inhibitor-containing coating composition is colored, whereby the bleach inhibitor-containing portion can be distinguished from dye image-forming portion. For instance, an appropriate dye can be incorporated in the coating composition containing the bleach inhibitor before coating. It is preferable that such a dye does not reduce the color sensitivity of the sound recording track portion of the color photographic material at printing the sound recording track portion and also has a color which can be distinguished at exposure under a safety lamp. For instance, in the case of a color photographic film having a blue-sensitive emulsion layer, a green-sensitive emulsion layer, and a red-sensitive emulsion layer for making cine positive color film, a dye absorbing light of a wavelength of about 580 nm is quite preferable for the above purposes.

Specific examples of such dyes absorbing light of a wavelength of about 580 nm are, for example,

Anthraquinones:

e.g.

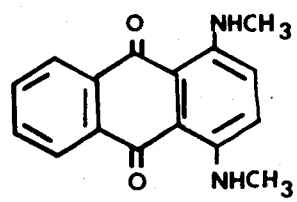

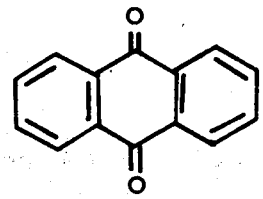

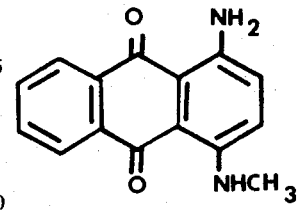

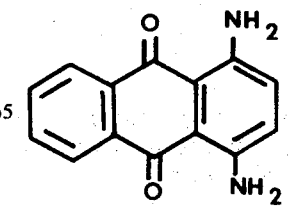

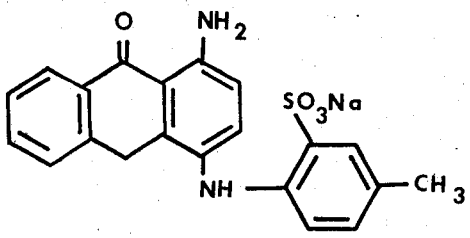
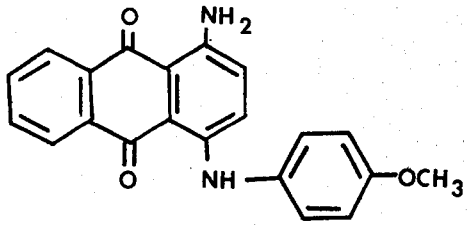
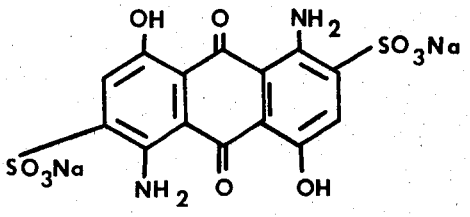
Triphenylmethanes:
e.g.;
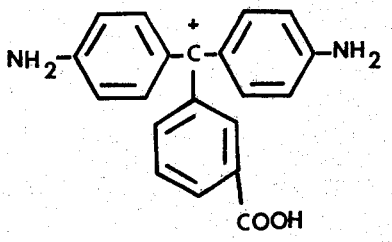
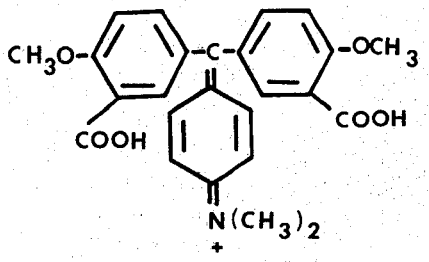
Azo dyes:
e.g.,
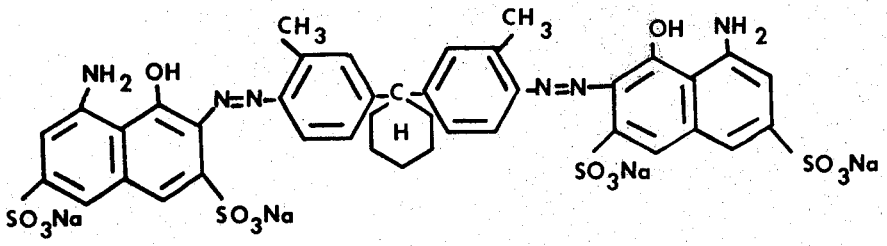
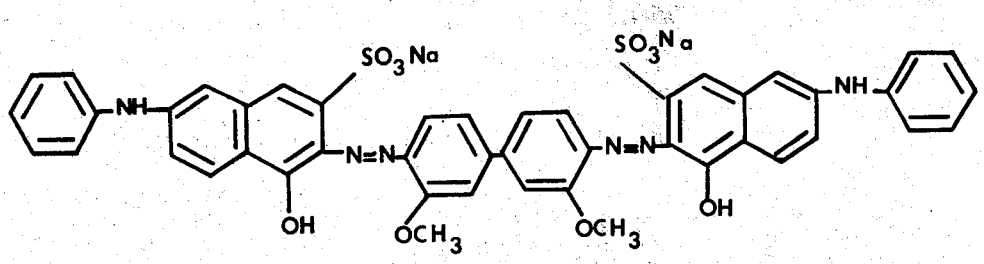
Oxonols:
e.g.,
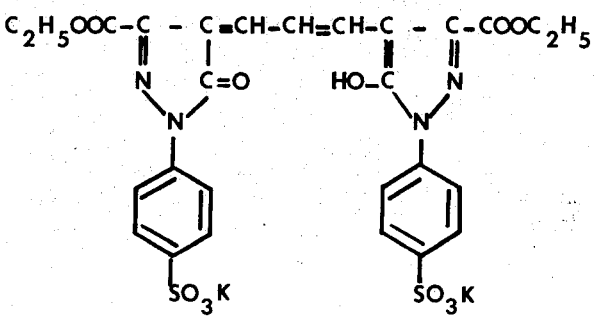

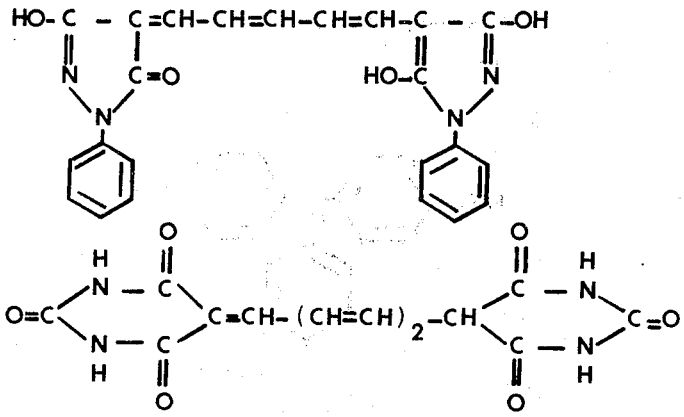

Styryls:

e.g.

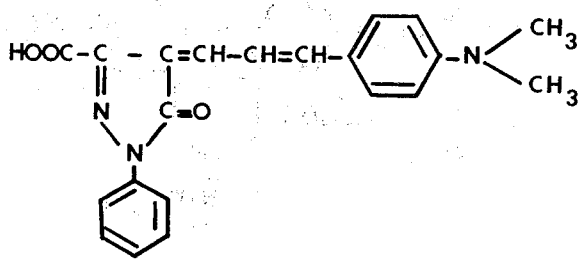

In the steps of producing the color photographic films of this invention, the coating composition containing the bleach inhibitor can be coated using known methods such as, for instance, a roller-type applicator, a hopper-type applicator, and the like.

The color photographic film of this invention is subjected to an exposure for color images and sound images using conventional techniques and then subjected to a conventional color processing step.

Typical examples of useful processing techniques are described in the *Journal of the Society of Motion Picture and Television Engineers*, volume 61, pages 667–701 (1953) and the *British Journal of Photography*, pages 122–123, 126 (1960).

Typical color developing agents are described in C.E.K. Mees and T.H. James, *The Theory of the Photographic Process*, pages 294–295 (The Macmillan Co. 1966), and U.S. Pat. Nos. 2,592,364 and 2,193,015.

As is known to those skilled in the art, photographic processing temperatures typically range from about 20°C or less to 60°C or higher. Temperatures of about 30°C or higher are suitable for high speed processing procedures. Processing times for each processing step can vary widely, depending on the processing temperature, but usually range from several seconds to several minutes or more.

When the color photographic material of this invention is used as a negative-positive type positive film for movies, the material is processed using the following main processing steps:

1. Color development
2. Stop or fix
3. Bleach and fix or alternatively blix.

Of these processing steps, step 2 can be omitted. Also, if necessary, a washing step may be inserted between the steps. Furthermore, the photographic film is washed and dried after step 3 and in this case it is desirable to process the film in a stabilization bath before drying.

A useful color developer used in the color development for the color photographic film is an alkaline aqueous solution containing a color developing agent. As the color developing agent, there are the primary aromatic amine dye forming developing agents such as the phenylenediamines. Specific examples of such phenylenediamines are N,N-diethyl-p-phenylenediamine, N-ethyl-N-hydroxyethyl-p-phenylenediamine, N-ethyl-N-hydroxyethyl-2-methyl-p-phenylenediamine, N-ethyl-β-N-methanesulfonamide, ethyl-3-methyl-4-aminoaniline, N,N-diethyl-2-methyl-p-phenylenediamine, and the sulfates, hydrochlorides, and sulfites thereof. The color developer can contain conventional additives such as an alkali metal sulfite, an alkali metal carbonate, an alkali metal bisulfate, an alkali metal bromide, an alkali metal iodide, benzyl alcohol, etc.

The stop solution usually contains a pH reducing agent such as acetic acid, phthalic acid, etc. The fix solution usually contains a fixing agent such as sodium thiosulfate, potassium thiocyanide, etc. The bleach solution contains a bleaching agent such as a ferricyanide, a bichromate, ethylenediamine tetraacetate, etc. Typical bleaching agents are discussed in detail in the *Journal of the Society of Motion Picture and Television Engineers*, 61, 667–701 and U.S. Pat. No. 3,189,452; typical fixing agents in L.F.A. Mason, *Photographic Processing Chemistry*, pages 187–188, Focal Press (1966); these references also disclose proportions suitable for use.

Furthermore, the bleach step and the fix step can be conducted in one bath in this invention. Typical blix solutions are disclosed in German Pat. Nos. 866,605 and 966,410, in *British Journal of Photography*, pages 122–123 and 126 (1966) and in U.S. Pat. No. 3,582,322. These references also disclose suitable proportions which can be used. This has been impossible in the color developing process requiring sound development using conventional techniques. In other words, by employing the present invention, a blix bath can be used in the color development processings, which simplifies the entire process and further shortens the processing period of time.

The blix solution used in this case contains a solvent for silver halide. Examples of such solvents are, for instance, a water-soluble thiosulfate such as sodium sulfate, potassium thiosulfate, ammonium thiosulfate, etc.; a water-soluble thiocyanate such as sodium thiocyanate, potassium thiocyanate, ammonium thiocyanate, etc.; a water-soluble organic thiol fixing agent containing an oxygen atom or a sulfur atom such as 3-thia-1,5-pentandiol, 3,6-dithia-1,8-octanediol, 9-oxa-3,6,12,15-tetrathiaheptadecanediol, etc.; a water-soluble sulfur-containing organic dibasic acid or a water-soluble salt thereof, such as ethylene bis-thioglycolic acid, a sodium salt thereof, etc.; an imidazolidinethion such as methylimidazolidinethion, etc.

sulfite, potassium bromide, potassium iodide, sodium iodide, polyalkylene oxides, 2-mercaptoimidazole, 3-mercapto-1,2,4-triazole, diethioglycol, thiourea, ethylene thiourea, hydroxyamine salts, p-aminophenol, ascorbic acid, semicarbazide, hydrazine, etc.

Specific examples of the composition for the blix bath which can be used in this invention are illustrated below:

| | |
|---|---|
| Bleaching Agent | as shown below |
| Sodium Carbonate (monohydrate) | 5 g |
| Boric Acid | 5 g |
| Sodium Sulfite | 5 g |
| Fixing Agent | as shown below |

The solution is adjusted to a pH of 6.0 and water is added to make the total volume 1.0 liter.

The bleaching agents and the fixing agents used in the above fix baths are as follows:

| Blix Bath | Bleaching Agent | Fixing Agent |
|---|---|---|
| a) | 0.05 mol of ferric sulfate and 0.1 mol of di-sodium ethylenediamine tetraacetate | 0.6 mol of sodium thiosulfate |
| b) | 0.1 mol of sodium ferric ethylenediamine tetraacetic acid | 0.6 mol of sodium thiosulfate |
| c) | 0.1 mol of ferric salt of nitrilotriacetic acid | 0.6 mol of sodium thiosulfate |
| d) | 0.1 mol of ferric salt of N-hydroxyethyl . ethylenediamine triacetic acid | 0.6 mol of sodium thiosulfate |
| e) | 0.1 mol of sodium ferric ethylenediamine tetraacetic acid | 0.6 mol of potassium thiocyanide |
| f) | 0.1 mol of sodium ferric ethylenediamine tetraacetic acid | 0.5 mol of potassium thiocyanide and 0.5 mol of sodium thiosulfate |
| g) | 0.1 mol of sodium ferric ethylenediamine tetraacetic acid | 5 g of thiourea and 0.6 mol of sodium thiosulfate |

The oxidizing agents for silver used in conventional blix solutions can be all used in the blix bath for processing the color photographic films of this invention. As such oxidizing agents, there are, for example, a water-soluble ferricyanide such as sodium ferricyanide, potassium ferricyanide, ammonium ferricyanide, etc.; a water-soluble quinone such as quinone, chloroquinone, methylquinone, etc.; a water-soluble ferric salt such as ferric chloride, ferric sulfide, ferric thiocyanide, ferric oxalate, etc.; a water-soluble cupric salt such as cupric chloride, cupric nitrate, etc.; a water-soluble cobaltic salt such as cobaltic chloride, ammonium cobaltic nitrate, etc.; and the like. Also, polyvalent cations or alkali metal complex salts of water-soluble organic acids can be preferably used as the oxidizing agent.

Typical examples of such organic acids are malonic acid, tartaric acid, ethylmalonic acid, malic acid, fumaric acid, diglycolic acid, thioglycolic acid, ethyliminopropionic acid, nitrilotriacetic acid, ethylenediamine tetraacetic acid, aminotriacetic acid, ethylenedithioglycolic acid, diethioglycolic acid, and the like.

Suitable polyvalent cations are a ferric ion, a cobaltic ion, and a cupric ion. The particularly useful bleaching agent is an iron-sodium complex salt of ethylenediamine tetraacetic acid.

The blix bath used for processing the color photographic films of this invention can advantageously contain such additives as are usually used in conventional blix solutions. Examples of such additives are sodium Then, when the color photographic material of this invention is used as a reversal material for movies, the photographic material is subjected to the following main processing steps after exposure.

1. Black and White Development
2. Reversal Exposure at Color Image Portions
3. Color Development
4. Stop or Fix
5. Bleach and then Fix or Alternatively Blix.

Of these steps, step 4 can be omitted and also if desired a washing step can be employed between the steps. After step 5, the photographic material is washed and dried but in this case, it is desirable to process the photographic material in a stabilization bath before drying.

A useful developer for the above-described black and white development is an alkaline aqueous solution containing a black and white developing agent. With respect to the other processing solutions, the compositions as stated in regard to the negative-positive type processings can be effectively employed.

When the color photographic material of this invention is developed using a color developer containing a color developing agent, silver images necessary for recording sound are formed simultaneously with the yellow, magenta, and cyan dyes for forming the color images. Of course, silver images are formed in the dye image portions but such silver images are readily bleached in the above-described bleach bath or blix bath. However, the silver images formed in the portion of the emulsion layer or layers containing the bleach inhibitor remain as silver images and are not bleached in the bleach bath or blix bath. Therefore, by employing the color photographic material of this invention, sound images (silver images) are obtained using ordinary color development processing and thus sound development processing for forming silver images as employed in conventional systems becomes unnecessary, which results in greatly simplifying the processing steps for color films having sound recording tracks. In other words, the use of the color photographic materials of this invention eliminates the necessity for the employment of silver sound development.

Furthermore, according to the present invention a color photographic film for movies having a sound recording track is obtained at a lower cost since it is unnecessary to form additionally a layer for forming the sound recording track as described in the specification of U.S. Pat. application Ser. No. 360,507, filed May 15, 1973 in addition to the conventional silver halide emulsion layers for color images and further as a result of such an advantage as mentioned above, no specific means for controlling the sensitivity and color sensitization region between a silver halide emulsion layer and the additional layer for forming sound recording track caused by superposing the latter layer on the former layer is necessary. Also, the color photographic film of this invention is not accompanied by a reduction in the sharpness of color images caused by the formation of the layer for the sound recording track. Moreover, the color photographic film of this invention has the advantage no reduction in density on the sound recording track portion due to the action of light, heat, or moisture occurs.

Still further, when a color photographic material has on the support a yellow colloidal silver-containing layer as a yellow filter layer or a black colloidal silver-containing layer as an antihalation layer, such a colloidal silver is rehalogenated in the bleaching step or blixing step and the silver halide thus formed is developed at sound development, and hence it has hitherto been impossible to apply a sound development processing to such a color photographic material using conventional techniques. However, in the present invention such a sound development becomes unnecessary which results in making it possible to use such a colloidal silver-containing layer in the color photographic material.

The invention will further be explained in greater detail by reference to the following examples. Unless otherwise indicated all parts, percents, ratios and the like are by weight.

EXAMPLE 1

A cellulose acetate film support having on the back surface an antihalation layer containing 70% by weight cellulose acetate phthalate and 30% by weight carbon black in an amount of 0.5 g/m² of the support of carbon black was coated with a subbing layer of the following composition Subbing Layer Composition:

| | (%) by weight |
|---|---|
| Gelatin | 1.2 |
| Glacial Acetic Acid | 1.2 |
| Water | 3 |
| Acetone | 70 |
| Ethanol | 24.6 |

in an amount of 0.6 g/m² of the support and then with a coating composition containing a silver iodobromide emulsion (containing 0.05 mol of silver) containing 1.2 mol percent iodine (1.2 g/m² of silver) and a dispersion prepared by dispersing a yellow coupler α-(2-methylbenzoyl)-3-[α-(2,4-di-tert-amylphenoxy)acetamido]-acetanilide having the following formula

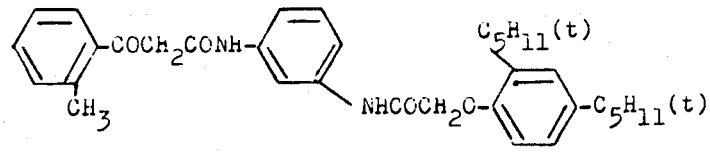

(1.2 g/m²) using dibutyl phthalate and ethyl acetate to provide a blue-sensitive layer (gelatin 3.0 g/m²). On the blue-sensitive layer was coated a gelatin intermediate layer and further on the layer was coated, as a red-sensitive layer (1.8 g/m² of gelatin), a coating composition containing 100 g (0.06 mol of silver) of silver chlorobromide emulsion containing 30 mol percent bromine (0.8 g/m² of silver), the silver halide emulsion having been sensitized spectrally so that it had a sensitization maximum at about 685 mμ, and a dispersion prepared by dispersing a cyan coupler, 1-hydroxy-4-chloro-N-hexadecyl-N-(2-cyanoethyl)-2-naphthamide (1.5 g/m²) having the formula

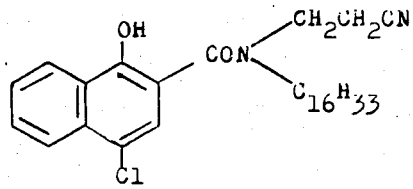

The spectral-sensitization dye used for the above silver halide emulsion (25 mg dye/mol silver) had the following structure

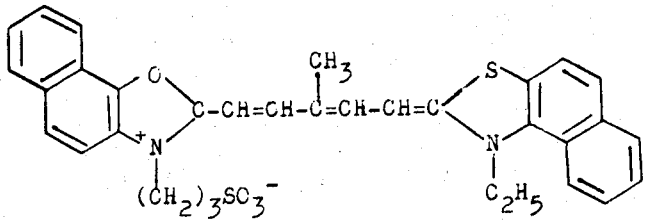

On the red-sensitive layer was coated a gelatin intermediate layer and then on this layer was coated, as a green-sensitive layer (3.0 g of gelatin/m²), a coating composition containing a silver chlorobromide emulsion (containing 0.06 mol of silver) containing 35 mol percent bromine (1.1 g/m² of silver), the silver halide emulsion having been sensitized spectrally so that it had a sensitization maximum at about 555 mμ, and a dispersion prepared by dispersing magenta couplers 1-(2,6-dichloro-4-methylphenyl)-3-{3-[α-2,4-di-tert-amylphenoxy)butylamido]benzamido}-5-pyrazolone (0.75g/m²) having the following formula

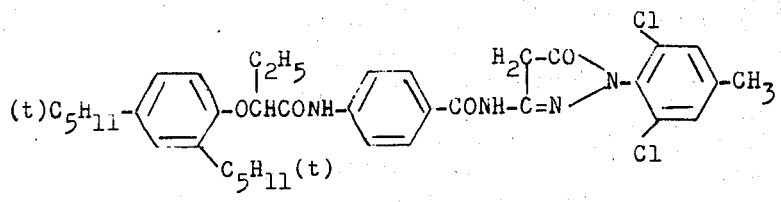

and 1-(2,4,6-trichlorophenyl)-3-{3-[α-(2,4-di-tert-amylphenoxy)butylamido]benzamido}-5-pyrazolone (0.75g/m²) having the formula

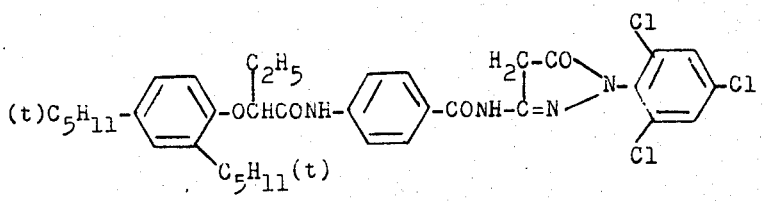

using tricresylphosphate and ethyl acetate.

The spectral-sensitization dye used (250 mg/mol silver) had the following structure.

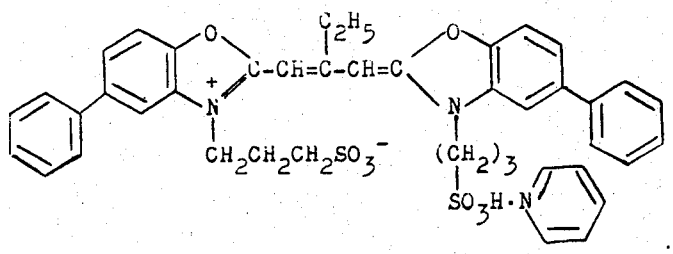

Finally, a coating composition prepared by dispersing liquid paraffin in an aqueous gelatin solution was coated on the green-sensitive emulsion layer as a protective layer. The color pring film thus prepared was designated as Sample I.

Also, a color print film was prepared by coating the blue-sensitive emulsion layer, the red-sensitive emulsion layer, and the green-sensitive emulsion layer on a support as in the case of producing Sample I and then the coating composition having the following composition was coated thereon, the color print film being designated Sample II.

Composition of the Coating Composition:

| | |
|---|---|
| Tragacanth Gum | 5 g |
| 2-Mercapto-7-hexylamido-benzthiazole | 1 g |
| Ethanol | 20 ml |
| Water | 900 ml. |

Each of Samples I and II thus prepared was exposed to a tungsten light source through an intensity scale sensitomeric step wedge using a ultraviolet absorption filter transmitting light having wave lengths longer than about 400 nμ, a yellow filter transmitting light having wave lengths longer than about 500 nμ, and a silver wedge. The filters used at the exposure were those usually used in the exposure of conventional color print films. Then, the samples thus exposed were processed according to the following processes A and B.

The densities of the films thus processed in the infrared regions were measured using a Macbeth TD-206A densitometer through a Status S-58 filter, the results of which are shown in Table 1.

Process A

| Processing Step | Temperature | Time |
|---|---|---|
| Pre-treatment | 27°C | 10 sec. |
| Wash | " | 15 sec. |
| Color Development | " | 5 min. 20 sec. |
| Wash | " | 15 sec. |
| First Fix | " | 1 min. |
| Wash | " | 40 sec. |
| Bleach | " | 3 min. |
| Wash | " | 1 min. |
| Sound Development | room temp. | 15 sec. |
| Wash | 27°C | 15 sec. |
| Second Fix | " | 2 min. |
| Wash | " | 5 min. |
| Stabilization | " | 10 sec. |

The compositions of the processing solutions employed in the above steps were as follows:

| | |
|---|---|
| Pre-treatment Solution: | |
| Water | 800 ml |
| Sodium Carbonate (mono-hydrate) | 10.0 g |
| Sodium Sulfate (anhydrous) | 50.0 g |
| Water to make | 1.0 liter |
| Color Development Solution: | |
| Sodium Hexametaphosphate | 2.0 g |
| Water | 800 ml |
| Sodium Sulfite (anhydrous) | 4.0 g |
| 2-Amino-5-diethylaminotoluene Hydrochloride | 3.0 g |
| Sodium Carbonate (mono-hydrate) | 25.0 g |
| Potassium Bromide | 2.0 g |
| Water to make | 1.0 liter |
| First Fix Solution and Second Fix Solution: | |
| Water | 600 ml |
| Sodium Thiosulfate (penta-hydrate) | 240 g |
| Sodium Sulfite (anhydrous) | 15.0 g |
| Glacial Acetic Acid | 12.0 g |
| Boric Acid | 6.0 g |
| Potassium Alum | 15.0 g |
| Water to make | 1.0 liter |
| Bleach Solution: | |
| Water | 800 ml |
| Potassium Bromide | 20.0 g |
| Potassium Bichromate | 5.0 g |
| Potassium Alum | 40.0 g |
| Sodium Acetate (tri-hydrate) | 3.0 g |
| Glacial Acetic Acid | 10.0 g |
| Water to make | 1.0 liter |
| Sound Development solution: | |
| (Solution A): | |
| Water | 600 ml |
| Sodium Sulfite (anhydrous) | 40.0 g |
| N-Methyl-n-aminophenol Sulfate | 40.0 g |
| Sodium Hydroxide | 40.0 g |
| Hydroquinone | 40.0 g |
| (Solution B): | |
| Water | 300 ml |
| Tragacanth Gum | 5.0 g |
| Ethanol | 10 ml |
| (Solution C): | |
| Ethylenediamine | 20 ml |

Solution A was mixed with Solution B and immediately before use, Solution C and water were added to the mixture to make the total volume 1.0 liter.

| | |
|---|---|
| Stabilization Bath: | |
| Water | 800 ml |
| Formalin (37%) | 10 ml |
| Polyethylene Glycol (having a molecular weight of about 400; aqueous solution) | 5 ml |
| Water to make | 1.0 liter |

Process B

| Processing Step | Temperature | Time |
|---|---|---|
| Pre-treatment | 27°C | 10 sec. |
| Wash | " | 15 sec. |
| Color Development | " | 5 min. 20 sec. |
| Wash | " | 15 sec. |
| First Fix | " | 1 min. |
| Wash | " | 40 sec. |
| Bleach | " | 3 min. |
| Second Fix | " | 1 min. |
| Wash | " | 5 min. |
| Stabilization | " | 10 sec. |

The compositions of the processing solutions used in the above steps were same as those in process A.

Table 1

| | Sample | | | |
|---|---|---|---|---|
| | I | | II | |
| Process | A | B | A | B |
| Infrared Density | 2.02 | 0.05 | 2.03 | 2.00 |

From the results shown in Table 1, it can be understood that in Sample I the desired infrared density was not obtained without employing sound development, while in Sample II having a layer containing the bleach inhibitor, the high desired infrared density was obtained using ordinary color development.

EXAMPLE 2

By following the same procedure as in the preparation of Sample II in Example 1 forming, however, a black antihalation layer in a thickness of 1 micron using a solution composed of black colloidal silver (5 wt%) and gelatin (6 wt%) on a subbing layer on the silver halide emulsion-carrying side of the support in place of the antihalation layer containing black carbon black, Sample III was prepared. The sample film was exposed in the same way as described in Example 1, subjected to the process B (the pre-treatment and the latter was were, however, omitted), and then the infrared density of the film was measured in the same manner as described in Example 1, the results of which are shown in the following table.

Table 2

| | |
|---|---|
| Sample | III |
| Process | B |
| Infrared Density | 1.98 |

As shown in the above table, good results as in Example 1 were obtained in the color photographic film having the antihalation layer containing colloidal silver.

EXAMPLE 3

Samples I, II, and III as described in Examples 1 and 2 were exposed as described in Example 1, subjected to Process C as shown below, and then the infrared densities of the film samples were measured in the same manner as described in Example 1. The results obtained are shown in Table 3.

Process C

| Processing Step | Temperature | Time |
|---|---|---|
| Pre-treatment | 27°C | 10 sec. |
| Wash | " | 15 sec. |
| Color Development | " | 5 min. 20 sec. |
| Wash | " | 15 sec. |
| Blix | " | 4 min. |
| Wash | " | 2 min. |
| Stabilization | " | 10 sec. |

The composition of the blix bath used in the above step was as follows:

| | |
|---|---|
| Sodium Ferric Ethylenediamine Tetraacetic Acid | 34.0 g |
| Sodium Carbonate (mono-hydrate) | 11.0 g |
| Borax | 45.0 g |
| Sodium Thiosulfate | 140.0 g |
| Water to make | 1.0 liter |

The compositions of the processing solutions other than the blix bath were same as those for the above-described Process A in Example 1.

Table 3

| Sample | I | II | III |
|---|---|---|---|
| Process | C | C | C |
| Infrared density | 0.05 | 1.96 | 1.92 |

From the results shown in the above table it can be understood that in Samples II and III which are the color photographic materials of this invention, high infrared densities were obtained using the blix process without employing sound development while in Sample I which is a conventional color photographic material, the infrared density obtained was quite low.

EXAMPLE 4

By following the same procedure of producing Sample II described in Example 1 using the coating compositions containing the bleach inhibitors shown in Table 4 in place of the coating composition containing 2-mercapto-7-hexylamido-benzthiazole as the bleach inhibitor, Samples IV, V, and VI were prepared. These sample films thus prepared were exposed and processed in the manner as shown in Examples 1 and 3 and then the infrared densities of the films were measured, the results of which are shown in Table 4.

Table 4

| Sample | IV | | V | | VI | |
|---|---|---|---|---|---|---|
| Bleach inhibitor | (a) | | (b) | | (c) | |
| Process | B | C | B | C | B | C |
| Infrared density | 1.95 | 1.94 | 2.01 | 2.02 | 1.98 | 1.97 |

(a): 1-(3-Octylamidophenyl)-5-mercaptotetrazole
(b): 7-Hexylamido-2-mercapto-benzimidazole
(c): S-Methyl-2-mercaptoimidazole. HI Salt.

EXAMPLE 5

By following the same procedure as in the case of producing Sample II in Example 1 using the bleach inhibitor-containing coating composition having the following compositions, Samples VII, VIII, IX, and X were prepared.

| Coating Composition: | |
|---|---|
| Gantrez AN 169* | 5 g |
| Bleach Inhibitor | shown in Table 5 |
| Methanol | 500 ml |
| Water to make | 1 liter |

*a copolymer of methyl vinyl ether and maleic anhydride (molar ratio = 1:1) in which the specific viscosity as determined using a solution of 1 g of the copolymer in 100 ml of methyl ethyl ketone at 25°C is 2.6 – 3.5

These samples were exposed and processed in the manner as shown in Examples 1 and 3 and then the infrared densities were measured, the results of which are shown in Table 5.

Table 5

| Sample | Bleach Inhibitor | Amount | Infrared Density | |
|---|---|---|---|---|
| | | | B | C |
| VII | N-(2-Oxy-3-hexadecyloxy)-pyridinium chloride | 1 g | 1.97 | 2.00 |
| VIII | 2-Hexadecylthio-1,3-imidazole | 2.5 g | 1.99 | 1.96 |
| IX | 2-Oxy-4,6-dichlorotriazine-Sodium Salt | 10 g | 1.87 | 1.93 |
| X | 2-Hexadecylthio-1,3-imidazole and 2-Oxy-4,6-dichlorotriazine.-Sodium Salt | 1 g | 2.01 | 1.97 |

From the results shown in Table 5 it can be understood that high infrared densities were obtained in these cases.

EXAMPLE 6

According to the procedure as in the case of producing Sample I in Example 1, the blue-sensitive emulsion layer, the red-sensitive emulsion layer, the green-sensitive emulsion layer, and the protective layer were formed on a film support followed by drying. The color photographic film thus prepared was cut in a width of 32 mm along the longitudinal direction of the film, perforated using a perforator, and then cut in a width of 16 mm to provide Sample XI.

Then, the bleach inhibitor-containing coating composition as used in the production of Sample II in Example 1 was coated on the sound recording track portion of Sample XI defined by ASTM pH 22. 41-1969 using a hopper-type applicator to provide Sample XII.

Each of Samples XI and XII was exposed in a superimposed relation with a color image-having negative film, exposed further using the light source and filter as in Example 1 in a superimposed relation with a sound image-containing negative film having recorded thereon sound a frequency of 400 Hz and 1000 Hz, and then subjected to Process A or B to provide a cine positive color photographic film.

Using each of the photographic films, the reproductions of sound images and color images were conducted using of a 16 mm projector having an optical recording and reproducing device (16 mm SC Reproducer). Sharp color images were projected on a screen from both Samples XI and XII. The sound outputs obtained at the same time are shown in Table 6.

Table 6

| Sample | XI | | XII | |
|---|---|---|---|---|
| Process | A | B | A | B |
| Sound 400 Hz | 39 | 32 | 40 | 39 |
| Output* 1000 Hz | 17 | 12 | 18 | 17 |

*: The units are decibels.

From the results shown in Table 6 it can be understood that Sample XI which did not have the bleach inhibitor-containing layer gave insufficient sound output in Process B which did not include the sound development step, while Sample XII of this invention had sufficient sound output using both Process A and B.

EXAMPLE 7

By following the same procedure as in the case of producing Sample III in Example 2, the blue-sensitive emulsion layer, the red-sensitive emulsion layer, the green-sensitive emulsion layer, and the protective layer were formed on a film support followed by drying. The color photographic film thus prepared was cut in a width of 35 mm along the longitudinal direction of the film, perforated at both edge portions thereof using a perforator, and then a bleach inhibitor-containing coating composition having the following formula was coated on the sound recording track portion of the film defined by ASTM pH 22. 40-1967 using a roller-type applicator and dried to provide Sample XIII.

| Coating Composition: | |
|---|---|
| Gantrez AN 169 | 5 g |
| 7-Hexylamido-2-mercaptobenzimidazole | 1 g |
| 4,4'-(1-Propene-1-il-3-iridene)-bis-(1-phenyl-3-ethoxycarbonyl-pyrazoline-5-on) | 0.1 g |
| Methanol | 500 ml |
| Water to make | 1 liter |

The color photographic film thus prepared was exposed as in Example 6 and subjected to Process C to prepare a cine positive color photographic film. The color images and sound images of the color photographic film thus processed were reproduced using a 35 mm projector having an optical recording device having sensitivity in the infrared region, whereby sharp color images were projected on a screen and also good sound output was obtained.

While the invention has been described in detail and with reference to specific embodiments thereof, it will be apparent to one skilled in the art that various changes and modifications can be made therein without departing from the spirit and scope thereof.

What is claimed is:

1. An unexposed and unprocessed color photographic material comprising a support having thereon one or more silver halide color emulsion layers containing a coupler capable of forming a dye by reaction with the oxidation product of an aromatic primary amino developing agent and at least one of the emulsion layers of the color emulsion layers of the color photographic material containing a bleach inhibitor defining a sound track portion of said photographic material.

2. An unexposed and unprocessed color photographic material comprising a support having coated thereon a blue-sensitive silver halide emulsion layer containing a yellow dye-forming coupler, a red-sensitive silver halide emulsion layer containing a cyan dye-forming coupler, and a green-sensitive silver halide emulsion containing a magenta dye-forming coupler, at least one of the emulsion layers containing a bleach inhibitor defining a sound track defining portion of said photographic material.

3. The color photographic material as set forth in claim 2, in which said bleach inhibitor is a compound having at least one mercapto group.

4. The color photographic material as set forth in claim 2, in which said bleach inhibitor is a compound capable of forming a compound having at least one mercapto group by hydrolysis or reaction with the oxidation product of a color developing agent.

5. The color photographic material as set forth in claim 2, in which said bleach inhibitor is a compound having a thioether bond directly at an atom in the nitrogen-containing heterocyclic ring.

6. The color photographic material as set forth in claim 2, in which said bleach inhibitor is a nitrogen-containing heterocyclic compound in which at least one nitrogen atom thereof is connected to a group having more than 11 carbon atoms to thereby form a quaternary salt.

7. The color photographic material as set forth in claim 2, in which said bleach inhibitor is an aldehyde type gelatin hardening agent, a methylol type gelatin hardening agent, a 1,4-dioxane type gelatin hardening agent, an aziridine type gelatin hardening agent, an isooxazole type gelatin hardening agent, a carbodiimide type gelatin hardening agent, an active halogen type gelatin hardening agent, or an active vinyl type gelatin hardening agent, said bleach inhibitor being present in an amount of at least 4% by weight to the gelatin.

8. The color photographic material as set forth in claim 2, in which said bleach inhibitor is a compound having at least one oxyalkylene group.

9. The color photographic material as set forth in claim 1, in which the back surface of said support of said color photographic material is dyed or pigmented at the portion corresponding to said sound track portion on the silver halide emulsion layer side.

10. The color photographic material as set forth in claim 2, in which the back surface of said support of said color photographic material is dyed or pigmented at the portion corresponding to said sound track portion on the silver halide emulsion layer side.

11. The color photographic material as set forth in claim 1, in which the sound track portion of the silver halide emulsion layer or layers is dyed.

12. The color photographic material as set forth in claim 2, in which the sound track portion of the silver halide emulsion layer or layers is dyed.

13. An unexposed and unprocessed method of preparing a color photographic material having a sound track portion which comprises coating on a support a blue-sensitive silver halide emulsion layer containing a yellow dye-forming coupler, a red-sensitive silver halide emulsion layer containing a cyan dye-forming coupler, and a green-sensitive silver halide emulsion layer containing a magenta dye-forming coupler and then coating a coating composition containing a bleach inhibitor on a portion of the silver halide emulsion layer or layers which permeates into said layer or layers to define a sound track portion.

14. A method of forming color images and sound images on a color photographic material, which comprises exposing said color photographic material as set forth in claim 1 to visual and sound images and processing said material in the steps of color developing, stopping, first fixing, bleaching and second fixing.

15. A method of forming color images and sound images on a color photographic material, which comprises exposing said color photographic material as set forth in claim 1 to visual and sound images and processing said material in the steps of black and white developing, reversal exposing at the color image portions, color developing, stopping, first fixing, bleaching, and second fixing.

16. The method of forming color images and sound images as set forth in claim 14, in which said stopping and first fixing are conducted simultaneously.

17. The method of forming color images and sound images as set forth in claim 15, in which said stopping and first fixing are conducted simultaneously.

18. A method of forming color images and sound images on a color photographic material, which comprises exposing said color photographic material as set forth in claim 1 to visual and sound images and processing said material in the steps of color developing, stopping or stop-fixing, bleaching, and fixing.

19. A method of forming color images and sound images on a color photographic material, which comprises exposing said unexposed and unprocessed color photographic material as set forth in claim 1 to visual and sound images and processing said material with the steps of black and white developing, reversal exposing at the color image portions, color developing, stopping or stop-fixing, bleaching, and fixing.

20. A method of forming color images and sound images on a color photographic material, which comprises exposing said color photographic material as set forth in claim 1 to visual and sound images and processing said material in the steps of color developing, bleaching and fixing.

21. A method of forming color images and sound images on a color photographic material, which comprises exposing said color photographic material as set forth in claim 1 to visual and sound images and processing said material in the steps of black and white development, reversal exposing at the color image portion, color developing, bleaching and fixing.

22. The method of forming color images and sound images as set forth in claim 14 in which said bleaching and second fixing are conducted simultaneously.

23. The method of forming color images and sound images as set forth in claim 15, in which said bleaching and second fixing are conducted simultaneously.

* * * * *